US005564067A

United States Patent [19]

Hendricks

[11] Patent Number: 5,564,067

[45] Date of Patent: Oct. 8, 1996

[54] CONTROLLED-POROSITY TRAPPING PLUGS FOR SPACE CRYOGEN SYSTEM PHASE SEPARATORS

[75] Inventor: John B. Hendricks, Huntsville, Ala.

[73] Assignee: Alabama Cryogenic Engineering, Inc., Huntsville, Ala.

[21] Appl. No.: 530,873

[22] Filed: May 29, 1990

Related U.S. Application Data

[63] Continuation-in-part of Ser. No. 375,709, Jul. 5, 1989, Pat. No. 5,101,894.

[51] Int. Cl.[6] ..... H01F 3/02

[52] U.S. Cl. ..... 428/566; 428/613; 75/247; 75/248

[58] Field of Search ..... 62/36, 50.1, 51.1; 428/188, 566, 613; 419/8, 5, 24, 41; 75/247, 228, 248

[56] References Cited

U.S. PATENT DOCUMENTS

| | | | |
|---|---|---|---|
| 3,751,271 | 8/1973 | Kimura et al. | 106/40 R |
| 3,938,554 | 2/1976 | Samuels | 62/51.1 X |
| 3,980,445 | 9/1976 | Aleshin et al. | 75/224 |
| 4,070,207 | 1/1978 | Holdeman | 428/613 |
| 4,223,723 | 9/1980 | Hilal | 62/51.1 |
| 4,228,662 | 10/1980 | Klipping | 62/51.1 |
| 4,277,950 | 7/1981 | Eigenbrod et al. | 62/50.1 |
| 4,869,944 | 9/1989 | Harada et al. | 428/188 X |

*Primary Examiner*—Peter A. Nelson
*Attorney, Agent, or Firm*—C. A. Phillips; Joseph H. Beumer

[57] ABSTRACT

A trapping plug with unique characteristics provides phase separators for cryogenic storage systems for space applications. The plug has a body of high-thermal conductivity metal such as OFHC copper and a multiplicity of holes of uniform, extremely small diameter and uniformly spaced extending through the body. The hole diameters and their uniformity in size and spacing enable precise design of an operating system using disclosed criteria. Hole diameters at the range of interest for systems for long-term storage of cryogenics such as liquid hydrogen, that is, 0.1 to 5.0 microns, may be provided in the plugs. Multiple plugs or clusters of plugs disposed in a plate may be used as required. A storage system making use of the trapping plugs also includes external vent lines and a flow regulator that controls flow of vapor through the vent lines.

4 Claims, 2 Drawing Sheets

CONTROLLED-POROSITY TRAPPING PLUGS FOR SPACE CRYOGEN SYSTEM PHASE SEPARATORS

ORIGIN OF THE INVENTION

This invention was made with government support under SBIR Contract FO4611-87-C-0078. The government has certain rights in this invention.

CROSS REFERENCE OF RELATED APPLICATION

This application is a continuation-in-part of my application Ser. No. 07/375,709, filed Jul. 5, 1989, now U.S. Pat. No. 5,101,894.

FIELD OF THE INVENTION

This invention relates generally to liquid cryogenic storage systems for use in space and more particularly to phase separators for such systems.

BACKGROUND OF THE INVENTION

Facilities for long-term storage of cryogenic liquids in space are required for many missions, in particular, those that make use of stored cryogens such as liquid hydrogen for purposes of cooling of infrared detectors and other equipment that has an extremely low operating temperature. For operations in a microgravity environment of space, cryogenic storage systems preferably make use a phase separator to prevent loss of the cryogenic liquid and to take advantage of the latent heat of vaporization of the liquid cryogen before it is vented from the system.

One approach proposed for phase separators in space cryogenic systems is a thermodynamic vent system in which both liquid and vapor phases are discharged through a Joule-Thompson orifice. After leaving this orifice, the two-phase discharge is forced to flow through a heat exchanger tube that is coupled to the tank wall and/or to heat shields around the dewar. Ideally, the liquid phase discharge should all be converted to vapor in the heat exchanger tube to make use of the latent heat of evaporation of the discharged liquid. This approach presents disadvantages in that two-phase flow in zero gravity is poorly understood, with little existing experimental data. Thus, a good deal of uncertainty exists in the assumption that all of the liquid discharged from the tank will be converted to vapor before release from the system. Also, basic thermodynamics show that more efficient cooling is achieved if all liquid-vapor conversion takes place in the tank and no liquid at all is discharged from the tank.

U.S. Pat. No. 4,412,851, issued Nov. 1, 1983, shows a phase separator for use in zero gravity that has an inlet communicating with a cryogen reservoir and an outlet to space with a transfer chamber in between, with flow restrictors at the ends of the chamber and a pair of obturators between the flow restrictors, the obturators being operated alternately by a control system.

Phase separators using a porous plug of sintered high-thermal conductivity metal have also been used in cryogenic systems, the porous plug providing for phase separation by capillary action. Porous plugs as fabricated by prior methods and used or proposed for use in space cryogen systems present a significant disadvantage in that their porous structure is complex and irregular, and the individual pores do not extend entirely through the plug but rather form complex interconnected short flow paths. Such a structure does not lend itself to an analysis so as to enable design of an efficient operating system. A plug having holes of uniform diameter penetrating all the way through and uniformly spaced apart is needed to enable development of analytical models useful for design of an actual phase separator. Provision of a trapping plug with holes having these characteristics has not been possible previously for plugs needed for certain space cryogen systems owing to the extremely small diameters required for the holes, in particular, diameters in the low micron to submicron size. No practical method has been available for fabrication of plugs with uniform holes of such small sizes.

Trapping plugs for zero g phase separators should have the capability for operating under either wet or dry conditions without loss of liquid trapping, and they should be amenable to analytical treatment that enables prediction of thermodynamic operation for both conditions. The plugs should also be suitable for installation into the walls of typical cryogen storage dewars.

SUMMARY OF THE INVENTION

This invention is directed to a trapping plug for phase separators for use in space cryogen systems, the trapping plug comprising a disc or plate of high-thermal conductivity metal having a multiplicity of uniform-size, cylindrical holes extending all the way through the disc or plate. The holes may have a controlled diameter of a very small size such as required for space applications, in particular, in the low micron to submicron size range. Provision of trapping plugs with these characteristics is enabled by a fabrication process disclosed in my referenced co-pending application. The trapping plug, or clusters of plugs as required, may be disposed in the wall of a liquid cryogen tank to provide phase separation at the tank wall. Trapping plugs designed for a particular application using thermodynamic modeling can operate under either wet or dry conditions without loss of trapping fluid. The liquid wets the plug but is retained in the plug by surface tension forces and capillarity into very small holes. Evaporation takes place at the downstream face of the plug. A space cryogen storage system based on this trapping plug phase separator includes a cryogen tank having one or more trapping plugs as phase separators embedded in the tank wall, a vent pipe communicating with the plug outlet, and a downstream flow regulator valve opening the vent to space or to a high vacuum system of some kind.

Trapping plug phase separators embodying the invention provide important advantages over prior devices in their higher efficiency, simplicity, fewer numbers of failure modes, and part count.

It is, therefore, an object of this invention to provide a trapping plug for a phase separator that has holes of uniform diameter and spacing extending through the plug.

Another object is to provide such a trapping plug wherein the holes have a diameter in the range of low microns to submicron sizes.

Yet another object is to provide a phase separator for use in low gravity that retains the liquid phase of cryogenic fluids within a tank while allowing the vapor phase to escape.

Another object is to provide a method of fabricating such a trapping plug.

Another object is to provide a liquid cryogen storage system for long-term use in space.

DESCRIPTION OF THE PREFERRED EMBODIMENT

Figure 1B:
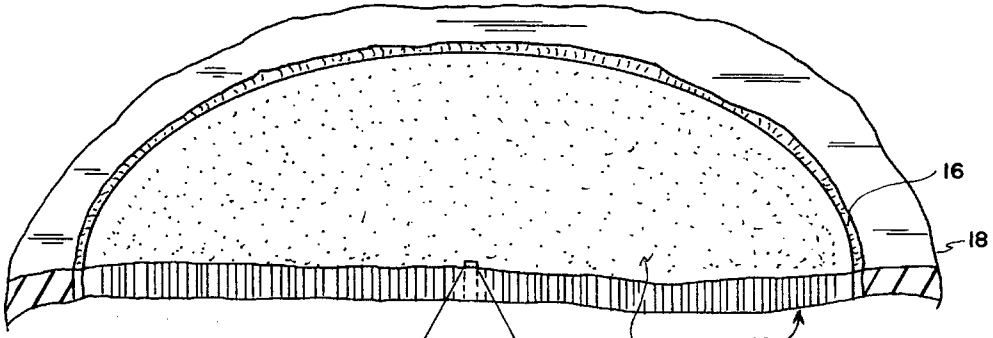
FIG. 1 is a pictorial view of a trapping plug embodying the invention, with a portion thereof highly enlarged.
Figure 1A:
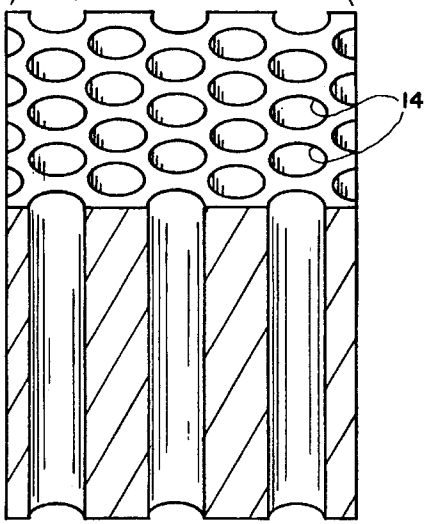

Referring to FIG. 1 of the drawings, there is shown a trapping plug embodying the invention. The plug 10 has a matrix of high-thermal conductivity metal, preferably OFHC copper, in the form of a circular disc or plate 12, with a multiplicity of very small holes 14 extending through the plate at right angles to the faces of the plate. Although the holes may have a larger diameter for other applications, for use in storage systems for cryogens such as liquid hydrogen in space, a diameter of 0.1 to 5.0 microns is generally required, with a specific diameter for a particular system being selected according to criteria given below. The holes in the matrix may be located in a particular geometric pattern owing to the method of fabrication, but such arrangement is not critical to functioning of the plugs. Necessary features for the plugs are the size and uniformity of the holes and the amount of porosity of the plug as a whole. A total porosity of up to thirty percent of the disc area is obtainable in this fabrication method, and its specific porosity below this value may also be selected using criteria given below. Maximum thickness of the disc is also limited by the method of fabrication to a value of about one-half inch. Thickness of the cryogen tank wall is not critical to the invention, and the required plug thickness for a given application need not be the same as the tank thickness. At plug thickness values below 1.0 mm, the plug becomes difficult to install, and its strength may be inadequate. As shown in FIG. 1, the plug may be mounted by a weld joint 16 securing it to the tank wall 18.

Figure 2:
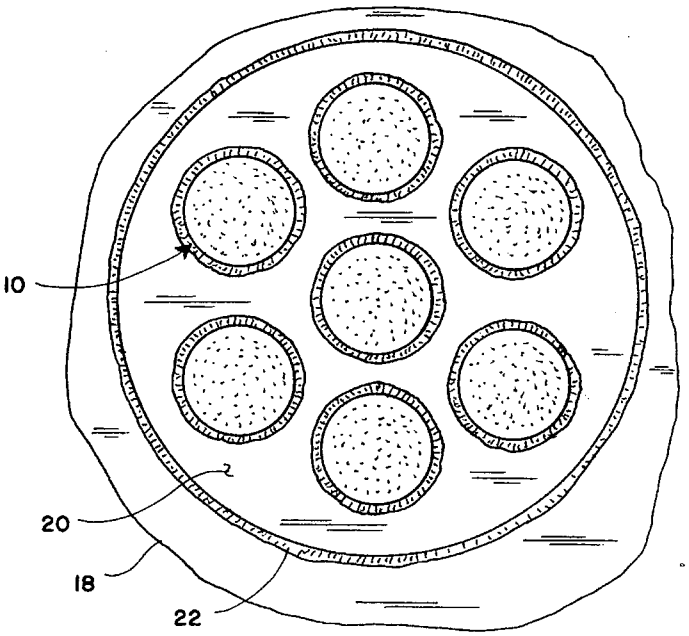
FIG. 2 is a planar view showing a cluster of plugs disposed in a high thermal conductivity plate.

FIG. 2 shows a cluster of trapping plugs 10 secured in a circular plate 20 of OFHC copper, which in turn is mounted by weld joint 22 securing it to the tank wall 18. This arrangement provides the necessary area for a given space cryogen system where the maximum obtainable area of a single plug would be insufficient to meet design criteria. Individual plugs may also be mounted to the tank wail at a plurality of sites, or a plurality of clusters of plugs may be mounted to the tank wall at different sites.

Figure 3:
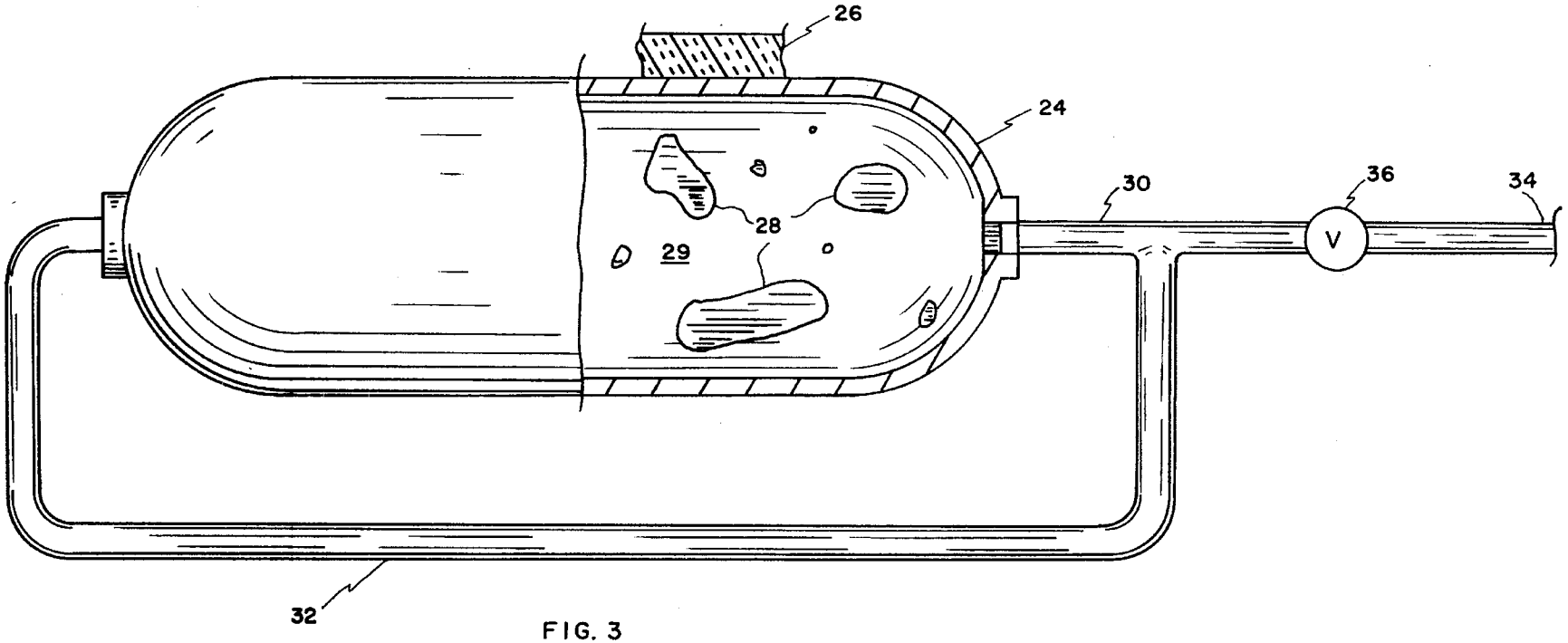
FIG. 3 is a planar view, partially cut away, showing a space cryogen storage system.

FIG. 3 shows a liquid cryogen storage system for long-term storage of a cryogen in space. The system includes a generally cylindrical storage tank 24 covered with external insulation 26. Vacuum insulation with surrounding layers of radiation shields may also be used. In the zero gravity environment of space, the stored cryogen such as hydrogen is contained in the form of a dispersed liquid 28 and a vapor phase 29 occupying the remainder of the tank. At desired locations of the tank, a trapping plug 10 is mounted in a high-thermal conductivity plate 20, which in turn is welded to the tank wall. Vent lines 30, 32 communicate the plug outlets with external space, allowing the vapor or escape at vent outlet 34. A flow regulation valve 36 disposed across the vent lines controls flow of the vapor in response to desired average tank temperature.

In order to design a trapping plug phase separator for a specific system, the heat transfer coefficient for an infinite fin may be used, assuming laminar, fully developed flow in the pores, to obtain the following expression for pressure drop across the pores:

$$P_i - P_e = 32\ \nu L\dot{m}/\epsilon d^2 \qquad (1)$$

where $\nu$=kinematic viscosity [Pa-s]

L=pore length [m]

$\dot{m}$=mass flux [kg/m$^2$ s]

$\epsilon$=porosity [dimensionless]

d=pore diameter [m]

$P_i$=pressure on upstream side of plug [Pa]

$P_e$=pressure on downstream side of plug [Pa].

This equation applies to both liquid and vapor flow through the plug.

A key criterion in plug design is to provide conditions so as to avoid cavitation, which may occur if vapor is removed at too high a rate from the downstream side of a plug. If cavitation occurs, the liquid interface may move back to the entrance of the pores. Such a transition would have a significant impact on the heat transfer of the trapping plug. In order to avoid cavitation, the following conditions must hold:.

$$R = 32\ \nu_1 LT/\epsilon\rho_v\lambda^2 d^2 (d/3.83\epsilon k_f + L/km(1-\epsilon))^{-1} > 1 \qquad (2)$$

where $\nu_1$=kinematic viscosity of the liquid [Pa-S]

$\lambda$=heat of vaporization [J/kg]

$k_f$=thermal conductivity of the fluid [W/(m.K)]

$k_m$=thermal conductivity of the copper [W/(m.K)]

T=average temperature of the plug [K]

$\rho_v$=vapor density [Kg/m$^3$].

In order to design an actual trapping plug system, the first step is to use equation 2 to ensure that cavitation does not occur. To achieve a margin of safety, it is preferred that equation 2 be sent equal to about 10 rather than 1. After inserting the thermodynamic parameters in equation 2, it can be solved for the required pore diameter d.

Since the kinematic viscosity for vapor is much larger than that for the liquid of the substance, a plug will remove much more heat from a system when it is wet than when it is dry. Therefore, it is logical to design the system under a worse case assumption that the plug is completely dry. From equation 1, we can write:

$$q_{max} = \dot{m}\lambda = \epsilon d^2 \lambda (P_i - P_e)/32\nu_v L \qquad (3)$$

where $P_i > P_e > (P_i - P_B)$ with $P_B = 4\sigma/d$ $\sigma$ is the surface tension of the liquid, $\nu_v$ is the kinematic viscosity of the vapor, and $q_{max}$ is the maximum amount of heat flux removed from the system by pure vapor flow through the plug, and $P_B$ is the breakout pressure. From this heat flux, the total plug area needed to dissipate a given system heat leak can be calculated.

As an example of the above approach, consider the phase separation of liquid hydrogen at 20K and 1 bar ($10^5$ Pa). For liquid hydrogen, it has been shown that in one micron diameter channel is too large to meet the critical condition. However, a diameter of 0.3 microns gives a value of nearly 10 for the left-hand side of equation 2. Plugs with this size hole may be manufactured by the process referred to above. Equation 3 is then evaluated for pure vapor flow at 20K and a pressure drop of $10^5$ Pa. The result for hydrogen is a specific heat flux of about 1.5 W/cm$^2$, a reasonable value. The corresponding pressure drop with the plug wet is then calculated. The value decreases by the ratio of the kinematic viscosities. A pressure drop of $2.2\times10^4$ Pa is therefore obtained for a wet plug. The breakthrough pressure for this diameter channel is around $2.5\times10^4$ Pa, providing a self-consistent design.

As indicated above, the maximum diameter plug with the pores having a diameter in the low micron and below range is about one-half inch. For many applications, more than one such plug would be required to provide sufficient vapor release capability for a particular system. The maximum heat leak that can be removed for a given trapping plug obeys the following proportionality:

$$q_{max} \propto nA/L \quad (4)$$

where n equals the number of holes per unit area, A equals total face area of the plug, and L is the plug thickness. A plurality of plugs may be provided in the cluster as shown in FIG. 2 to obtain the desired capability. Preferably the plugs are mounted in a plate of high-thermal conductivity metal of the same material as the plug to avoid differential thermal expansion problems. Each separate plug may be welded into the plate to provide a leak-tight seal. The plugs may also be thermally isolated from one another by mounting them in a matrix of a poor thermal conductor, such as stainless steel.

Plugs embodying the invention may be manufactured by the above-referenced process disclosed in my co-pending application. In this process, a bilet of sacrificial wire material such as NbTi alloy is disposed in an extrusion can of the desired plug material such as OFHC copper. The extrusion is extruded through a suitable die to produce an elongated, thinned-out rod having a center of the wire material. An assembly of extruded rods, machined to hexagonal cross section, is then stacked in an extrusion can, and the procedure is repeated until a desired number and size of wires is obtained in a composite rod. Holes through the plug are provided by selectively etching away the wire with an etchant, leaving a perforated matrix.

Although the invention is described with reference to trapping plugs for cryogenic systems operating at very low temperatures, these plugs may also find application in higher temperature systems using fluids such as chlorofluorocarbons. Plug parameters for other applications would be selected using design criteria given above.

The invention is not to be understood as limited to the embodiment described above, but is limited only as indicated by the appended claims.

I claim:

1. A trapping plug for a fluid phase separator comprising a plug body of high-thermal conductivity metal having flat upper and lower faces and a multiplicity of holes of uniform diameter from 0.1 to 5.0 microns extending through the plug perpendicular to said faces and uniformly spaced in said body.

2. A trapping plug as defined in claim 1 wherein said plug is prepared by disposing a billet of sacrificial wire material in an extrusion can of said high-thermal conductivity metal, extruding the resulting assembly through a die to produce an elongated, thinned-out rod having a center of said wire material, converting a plurality of extruded rods to hexagonal cross-sectional shape, stacking the extruded rods in an array in an extrusion can, re-extruding the stacked can until said wires are reduced to a diameter of 0.1 to 5.0 microns, and etching away said wires.

3. A trapping plug as defined in claim 1 wherein said body is comprised of copper.

4. A trapping plug as defined in claim 3 wherein said copper is OFHC copper.

* * * * *